US011629427B2

(12) United States Patent
Takemoto et al.

(10) Patent No.: US 11,629,427 B2
(45) Date of Patent: Apr. 18, 2023

(54) PLATING APPARATUS AND PLATING METHOD

(71) Applicant: Mitsubishi Electric Corporation, Tokyo (JP)

(72) Inventors: Yohei Takemoto, Tokyo (JP); Yutaka Akami, Tokyo (JP)

(73) Assignee: MITSUBISHI ELECTRIC CORPORATION, Tokyo (JP)

( * ) Notice: Subject to any disclaimer, the term of this patent is extended or adjusted under 35 U.S.C. 154(b) by 0 days.

(21) Appl. No.: 16/764,008

(22) PCT Filed: Nov. 27, 2018

(86) PCT No.: PCT/JP2018/043519
§ 371 (c)(1),
(2) Date: May 14, 2020

(87) PCT Pub. No.: WO2019/107339
PCT Pub. Date: Jun. 6, 2019

(65) Prior Publication Data

US 2020/0332430 A1 Oct. 22, 2020

(30) Foreign Application Priority Data

Nov. 30, 2017 (JP) ..... JP2017-230227

(51) Int. Cl.
*C25D 5/18* (2006.01)
*C25D 17/00* (2006.01)
(Continued)

(52) U.S. Cl.
CPC ..... *C25D 17/005* (2013.01); *C25D 5/04* (2013.01); *C25D 5/08* (2013.01); *C25D 5/18* (2013.01); *C25D 17/12* (2013.01)

(58) Field of Classification Search
None
See application file for complete search history.

(56) References Cited

U.S. PATENT DOCUMENTS 4,713,149 A 12/1987 Hoshino
2001/0042690 A1 11/2001 Talieh
(Continued)

FOREIGN PATENT DOCUMENTS

JP 62127492 A 6/1987
JP S63277785 A 11/1988
(Continued)

OTHER PUBLICATIONS

English Translation JP 2004-149926 (Year: 2004).*
(Continued)

*Primary Examiner* — Stefanie S Wittenberg
(74) *Attorney, Agent, or Firm* — Buchanan Ingersoll & Rooney PC

(57) ABSTRACT

The present invention relates to a plating apparatus and a plating method for partially forming a plating film on an object to be plated. The plating apparatus includes: a rotary electrode configured to be rotatable; a plating solution holding unit arranged to the rotary electrode and configured to hold a plating solution; and a power supply unit configured to apply a voltage between the portion to be plated and the rotary electrode.

9 Claims, 8 Drawing Sheets

(51) Int. Cl.

| | |
|---|---|
| ***C25D 5/04*** | (2006.01) |
| ***C25D 17/12*** | (2006.01) |
| ***C25D 5/08*** | (2006.01) |

(56) References Cited

U.S. PATENT DOCUMENTS

| | | | | |
|---|---|---|---|---|
| 2001/0054557 | A1* | 12/2001 | Taylor | C25D 5/627 205/255 |
| 2002/0033341 | A1* | 3/2002 | Taylor | C25D 5/611 205/291 |
| 2003/0057097 | A1 | 3/2003 | Tsai et al. | |
| 2005/0139482 | A1 | 6/2005 | Nagai et al. | |
| 2007/0131562 | A1* | 6/2007 | Wang | C25D 5/06 205/670 |
| 2009/0242418 | A1 | 10/2009 | Saito et al. | |

FOREIGN PATENT DOCUMENTS

| | | | | | |
|---|---|---|---|---|---|
| JP | H02170997 | A | | 7/1990 | |
| JP | H04176896 | A | | 6/1992 | |
| JP | H04180590 | A | | 6/1992 | |
| JP | H1192947 | A | | 4/1999 | |
| JP | 2004-149926 | A | | 5/2004 | |
| JP | 2004149926 | | * | 5/2004 | C25D 7/12 |
| JP | 2005264281 | A | | 9/2005 | |
| JP | 2008202139 | A | | 9/2008 | |
| JP | 2009-052061 | A | | 3/2009 | |
| JP | 2009228121 | A | | 10/2009 | |
| JP | 2010095775 | A | | 4/2010 | |
| KR | 20070021162 | | * | 2/2007 | B23H 5/08 |

OTHER PUBLICATIONS

Extended European Search Report dated Jan. 13, 2021 for European Patent Application No. 18884618.2, 7 pages.

International Search Report (with English Translation) and Written Opinion issued in corresponding International Patent Application No. PCT/JP2018/043519, 9 pages (dated Jan. 15, 2019).

Office Action dated Feb. 2, 2021 issued by the Japan Patent Office in Japanese Patent Application No. 2019-557229, with English translation (8 pages).

Office Action (Notice of Reasons for Refusal) dated Aug. 24, 2021, by the Japanese Patent Office in corresponding Japanese Patent Application No. 2019-557229 and English translation of the Office Action. (8 pages).

* cited by examiner

FIG.9

| | | PLATING CONDITIONS | | | | | |
|---|---|---|---|---|---|---|---|
| | | PRESENCE OR ABSENCE OF VERTICAL PORTION OF ROTARY ELECTRODE | MATERIAL F OR ROTARY ELECTRODE | ELECTRODE SIZE OR ELECTRODE SHAPE [mm] | CURRENT DENSITY [A/dm$^2$] | PR control | TARGET PLATING THICKNESS [μm] |
| EXAMPLES | 1 | ABSENT | Pt | ϕ 5 0 0 | 1 5 | ABSENT | 2 |
| | 2 | ABSENT | Pt | ϕ 5 0 0 | 1 5 | ABSENT | 5 |
| | 3 | ABSENT | Pt | ϕ 5 0 0 | 1 5 | ABSENT | 1 0 |
| | 4 | PRESENT | Pt | ϕ 5 0 0 | 1 5 | ABSENT | 2 |
| | 5 | PRESENT | Pt | ϕ 5 0 0 | 1 5 | ABSENT | 5 |
| | 6 | PRESENT | Pt | ϕ 5 0 0 | 1 5 | ABSENT | 1 0 |
| | 7 | ABSENT | Pt | ϕ 5 0 0 | 1 5 | PRESENT | 2 |
| | 8 | ABSENT | Pt | ϕ 5 0 0 | 1 5 | PRESENT | 5 |
| | 9 | ABSENT | Pt | ϕ 5 0 0 | 1 5 | PRESENT | 1 0 |
| | 1 0 | PRESENT | Pt | ϕ 5 0 0 | 1 5 | PRESENT | 2 |
| | 1 1 | PRESENT | Pt | ϕ 5 0 0 | 1 5 | PRESENT | 5 |
| | 1 2 | PRESENT | Pt | ϕ 5 0 0 | 1 5 | PRESENT | 1 0 |
| COMPARATIVE EXAMPLES | 1 3 | — | Pt | BRUSH-SHAPED ELECTRODE | 1 5 | ABSENT | 2 |
| | 1 4 | — | Pt | BRUSH-SHAPED ELECTRODE | 1 5 | ABSENT | 5 |
| | 1 5 | — | Pt | BRUSH-SHAPED ELECTRODE | 1 5 | ABSENT | 1 0 |

FIG. 10

| | | VARIATION IN FILM THICKNESS [σ/AVERAGE] | PLATING BURNING | FRAYED PORTION IN PLATING FILM | PEELING OF FILM (SIDE SURFACE PORTION) |
|---|---|---|---|---|---|
| EXAMPLES | 1 | 13.0% | ABSENT | ABSENT | PRESENT |
| | 2 | 12.3% | ABSENT | PRESENT | PRESENT |
| | 3 | 18.5% | ABSENT | PRESENT | PRESENT |
| | 4 | 8.9% | ABSENT | ABSENT | ABSENT |
| | 5 | 11.1% | ABSENT | PRESENT | ABSENT |
| | 6 | 16.6% | ABSENT | PRESENT | ABSENT |
| | 7 | 4.6% | ABSENT | ABSENT | PRESENT |
| | 8 | 8.5% | ABSENT | ABSENT | PRESENT |
| | 9 | 14.8% | ABSENT | ABSENT | PRESENT |
| | 10 | 4.4% | ABSENT | ABSENT | ABSENT |
| | 11 | 7.6% | ABSENT | ABSENT | ABSENT |
| | 12 | 8.9% | ABSENT | ABSENT | ABSENT |
| COMPARATIVE EXAMPLES | 13 | 30.9% | PRESENT | ABSENT | PRESENT |
| | 14 | 40.8% | PRESENT | PRESENT | PRESENT |
| | 15 | 32.4% | PRESENT | PRESENT | PRESENT |

PLATING APPARATUS AND PLATING METHOD

TECHNICAL FIELD

The present invention relates to a plating apparatus and a plating method for partially forming a plating film on an object to be plated.

BACKGROUND ART

Electroplating is used when a plating film is formed on a metal material. In the electroplating, it is required that the formation of the plating film on a portion other than a portion to be plated be suppressed. Therefore, a masking operation in which such portion is protected with a masking material, such as an insulating tape or a resist, is performed as a preparation operation before the plating. However, there is a problem in that a lead time is increased owing to the masking operation, which inhibits rectification of manufacturing.

As a technology for solving such problem, for example, a plating method called a brush plating method is proposed. This is a method of reciprocating an electrode while bringing the electrode into contact with a portion to be plated having applied thereto a plating solution. In the related-art brush plating method, a voltage is applied between the electrode and the portion to be plated electrically connected to each other, and thus a plating film can be formed on an arbitrary surface (see, for example, Patent Literature 1).

CITATION LIST

Patent Literature

[PTL 1] JP 2-170997 A

SUMMARY OF INVENTION

Technical Problem

However, in the related-art brush plating method described in Patent Literature 1, a film formation rate is high because of a high current density. Therefore, when brush plating is performed on the portion to be plated at a high current density, electric field concentration occurs at an end portion of the portion to be plated owing to the reciprocating movement. In addition, control parameters related to the thickness of the plating film are difficult to control. For example, a contact time of the electrode to the portion to be plated is difficult to control. As a result, the film formation rate becomes unstable, and the thickness of the plating film varies in the plane of the portion to be plated. Accordingly, the thickness of the plating film is liable to become non-uniform.

The present invention has been made in order to solve the above-mentioned problem. That is, an object of the present invention is to obtain a plating apparatus and a plating method each capable of suppressing the thickness of a plating film from becoming non-uniform.

Solution to Problem

According to one embodiment of the present invention, there is provided a plating apparatus, which is configured to form a plating film on a portion to be plated of an object to be plated, the plating apparatus including: a rotary electrode configured to be rotatable; a plating solution holding unit arranged to the rotary electrode and configured to hold a plating solution; and a power supply unit configured to apply a voltage between the portion to be plated brought into contact with the plating solution holding unit and the rotary electrode.

According to one embodiment of the present invention, there is provided a plating method, including, under a state in which a portion to be plated of an object to be plated is brought into contact with a plating solution holding unit having held a plating solution, while rotating a rotary electrode having arranged thereto the plating solution holding unit, applying a voltage between the portion to be plated and the rotary electrode.

Advantageous Effects of Invention

In each of the plating apparatus and the plating method according to the one embodiment of the present invention, the rotary electrode is used as an electrode, and hence electric field concentration at an end portion of the portion to be plated can be prevented, and the thickness of the plating film can be suppressed from becoming non-uniform.

BRIEF DESCRIPTION OF DRAWINGS

FIG. 9 is a table showing performance conditions of Examples according to the present invention.

FIG. 10 is a table showing performance results of Examples according to the present invention.

DESCRIPTION OF EMBODIMENTS

Now, embodiments of the present invention are described with reference to the drawings.

First Embodiment

Figure 1:
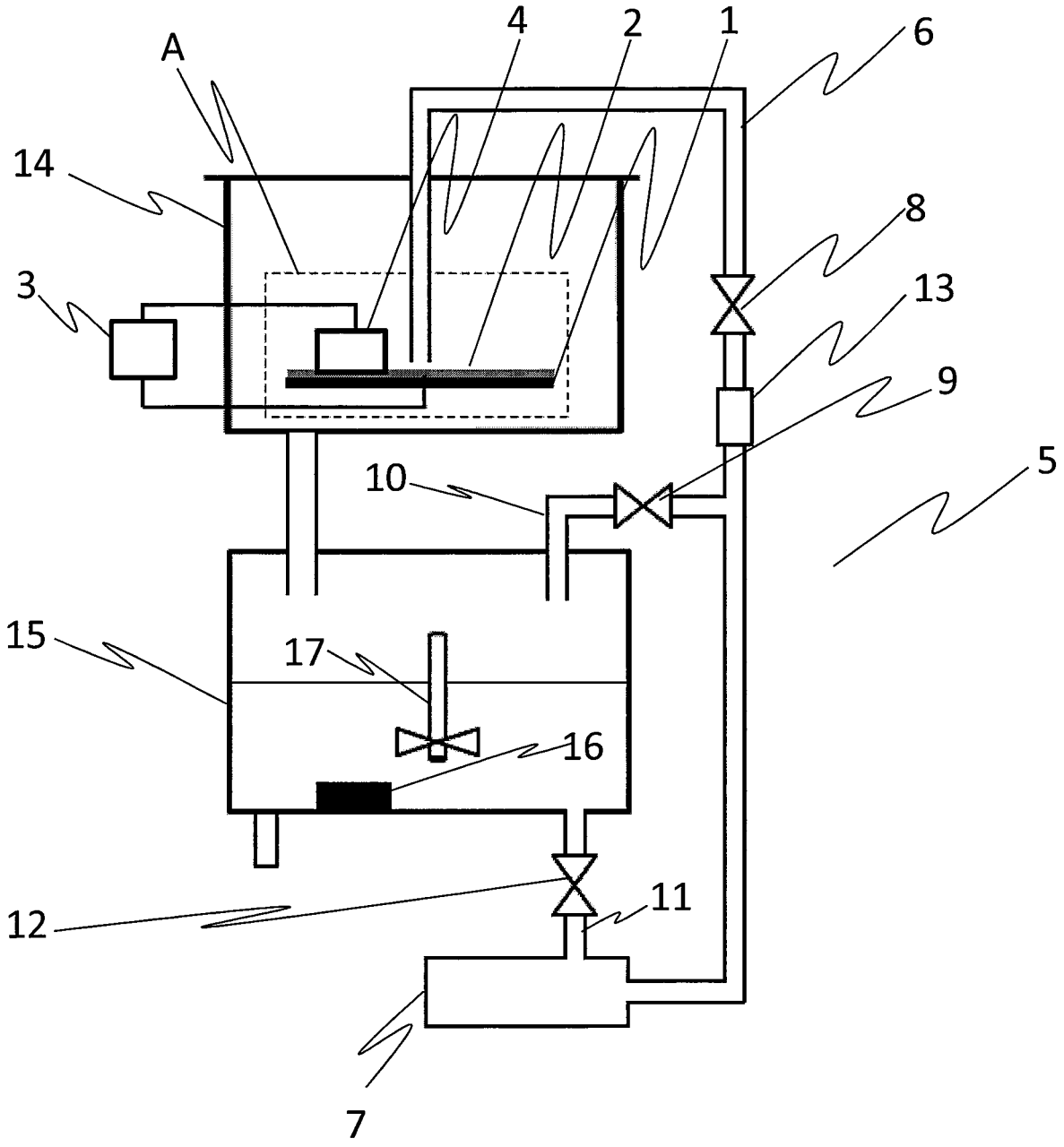
FIG. 1 is a configuration diagram for illustrating a plating apparatus according to a first embodiment of the present invention.
Figure 2:
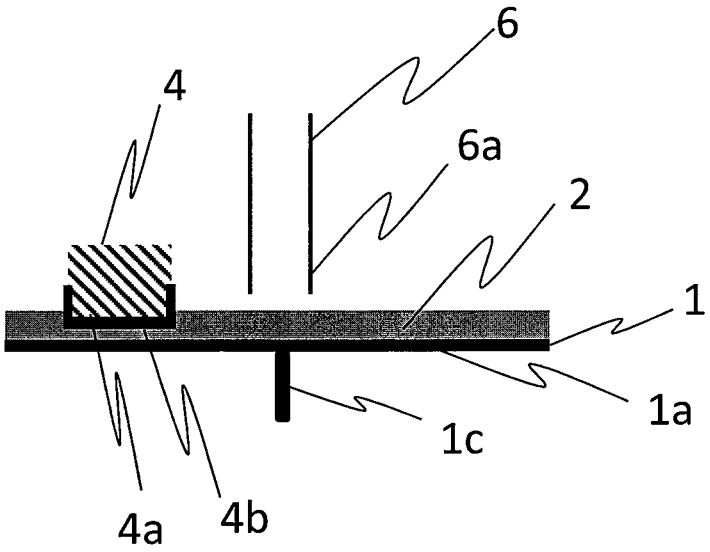
FIG. 2 is a sectional view for illustrating a portion A of FIG. 1.
Figure 3:
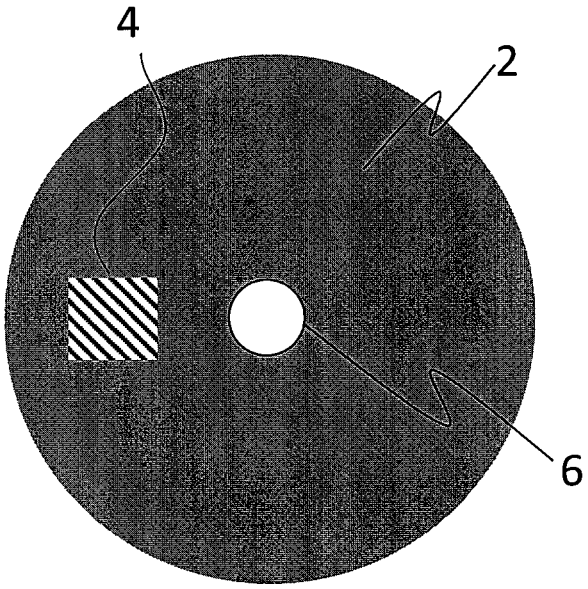
FIG. 3 is a top view for illustrating a rotary electrode of FIG. 2.

FIG. 1 is a configuration diagram for illustrating a plating apparatus according to a first embodiment of the present invention. In addition, FIG. 2 is a sectional view for illustrating a portion A of FIG. 1. Further, FIG. 3 is a top view for illustrating a rotary electrode of FIG. 2.

The plating apparatus of the first embodiment includes: a rotary electrode 1; a plating solution holding unit 2; and a power supply unit 3. The plating apparatus further includes:

a plating solution supply unit 5; a plating bath 14, a reservoir tank 15; a heater 16; and an agitator 17.

The rotary electrode 1 is formed of a material that is not dissolved in a target plating solution or that is hardly dissolved therein. As a material for forming the rotary electrode 1, for example, any one of platinum (Pt), titanium-platinum (Ti—Pt), titanium-iridium oxide (Ti—$IrO_2$), stainless steel (SUS), and carbon (C) is used. When titanium-platinum (Ti—Pt) is used as the material for the rotary electrode 1, a clad electrode in which a titanium (Ti) base is cladded with a platinum (Pt) foil is preferably used as the rotary electrode 1. In addition, a plating electrode in which a platinum (Pt) plating film is formed on the titanium (Ti) base may also be used as the rotary electrode 1.

The rotary electrode 1 includes a flat surface portion 1*a*. In addition, the rotary electrode 1 is horizontally held so as to be rotatable. A structure for holding the rotary electrode 1 so as to be rotatable may be, for example, the following structure.

Specifically, a shaft 1*c* is arranged to a center portion of an upper surface or a lower surface of the rotary electrode 1. The rotary electrode 1 is configured to be rotatable about the shaft 1*c*. A rotational force of a motor serving as a driving device (not shown) is transferred to the rotary electrode 1. The rotation number of the rotary electrode 1 is appropriately adjusted. As a transfer mechanism for transferring the rotational force of the motor to the rotary electrode 1, for example, a transfer mechanism of a gear type or a transfer mechanism of a belt type is used. In the transfer mechanism of a gear type, a gear for transfer is engaged with gear teeth arranged to the shaft 1*c* of the rotary electrode 1 or an outer peripheral surface of the rotary electrode 1. The rotational force of the motor is transferred to the rotary electrode 1 when the gear teeth receive the rotation of the gear for transfer. In the transfer mechanism of a belt type, an endless belt is looped over the shaft 1*c* of the rotary electrode 1 or the outer peripheral surface of the rotary electrode 1. The rotational force of the motor is transferred to the rotary electrode 1 when the belt circles. A terminal for applying a voltage is mounted to the rotary electrode 1.

The plating solution holding unit 2 is placed on the rotary electrode 1. In addition, the plating solution holding unit 2 is configured to hold a plating solution through impregnation therewith. As the plating solution holding unit 2, for example, woven fabric or non-woven fabric is used. Any material capable of holding the plating solution through impregnation therewith other than woven fabric or non-woven fabric may also be used as the plating solution holding unit 2. The rotary electrode 1 has a size larger than a plating area of an object 4 to be plated. That is, the entire surface of a portion 4*a* to be plated of the object 4 to be plated is placed on the rotary electrode 1 through intermediation of the plating solution holding unit 2.

As illustrated in FIG. 1, the rotary electrode 1 and the plating solution holding unit 2 are accommodated in the plating bath 14.

The power supply unit 3 is a power supply for electroplating. The power supply unit 3 is a DC power supply configured to apply a voltage between the rotary electrode 1 and the object 4 to be plated. The power supply unit 3 is electrically connected to the terminal brought into contact with the rotary electrode 1 and to the object 4 to be plated.

The plating solution supply unit 5 is configured to supply the plating solution to the plating solution holding unit 2. In addition, the plating solution supply unit 5 includes: a solution supply pipe 6; a pump 7; a solution supply valve 8; a flow rate adjusting valve 9; a flow rate adjusting pipe 10; a solution delivery pipe 11; a solution delivery valve 12; and a flow meter 13.

The pump 7 is connected to the reservoir tank 15 configured to store the plating solution through intermediation of the solution delivery pipe 11. The solution supply pipe 6 is connected to the pump 7. The solution supply pipe 6 and the solution delivery pipe 11 are each formed of a material that is not dissolved and deformed by the plating solution to be used. For example, the solution supply pipe 6 and the solution delivery pipe 11 are each formed of a material containing vinyl chloride as a main component. The solution supply pipe 6 has an ejection port 6*a* for the plating solution at an end portion on a plating solution outlet side. The ejection port 6*a* is inserted into the plating bath 14. In addition, the ejection port 6*a* is arranged above the rotary electrode 1. The plating solution stored in the reservoir tank 15 flows through the solution delivery pipe 11 and the solution supply pipe 6 in this order by a drive force of the pump 7, and is then ejected from the ejection port 6*a* toward the rotary electrode 1. The plating solution ejected from the ejection port 6*a* is held, through impregnation, by the plating solution holding unit 2 placed on the rotary electrode 1.

The arrangement position of the ejection port 6*a* with respect to the rotary electrode 1 may be adjusted so that the plating solution holding unit 2 effectively holds the plating solution through impregnation therewith. For example, when the rotary electrode 1 has a high rotation speed, the ejection port 6*a* is preferably arranged above the center portion of the rotary electrode 1. With this, by a centrifugal force caused by the rotation of the rotary electrode 1, the plating solution ejected from the ejection port 6*a* can be held, through impregnation, by the entirety of the plating solution holding unit 2 from the center portion of the rotary electrode 1.

Meanwhile, when the rotary electrode 1 has a low rotation speed, the ejection port 6*a* is preferably arranged above a circular path including the position of the object 4 to be plated placed on the rotary electrode 1. That is, when the rotary electrode 1 has a low rotation speed, the ejection port 6*a* is preferably arranged above a circular track of the object to be plated on the rotary electrode 1 when the rotary electrode 1 is rotating. The arrangement position of the ejection port 6*a* may be appropriately changed depending on the ejection flow rate of the plating solution from the ejection port 6*a*. For example, when the ejection flow rate of the plating solution from the ejection port 6*a* is low, the ejection port 6*a* is preferably arranged so that the plating solution is brought into contact with the object 4 to be plated immediately after its ejection in order to suppress a reduction in concentration of the plating solution owing to spreading on the rotary electrode 1. That is, in this case, the ejection port 6*a* is preferably arranged close to a back surface of the object 4 to be plated with respect to a rotation direction of the rotary electrode 1.

The solution supply valve 8 and the flow meter 13 are mounted to the solution supply pipe 6. In addition, the flow rate adjusting pipe 10 is connected between the solution supply pipe 6 and the reservoir tank 15. The flow rate adjusting valve 9 is mounted to the flow rate adjusting pipe 10. The supply amount of the plating solution to be supplied from the ejection port 6*a* to the plating solution holding unit 2 may be adjusted by the solution supply valve 8 and the flow rate adjusting valve 9.

The residual plating solution in the plating bath 14 is returned to the reservoir tank 15. With this, the plating solution supply unit 5 is configured to be able to collect the plating solution having been supplied to the plating solution holding unit 2, and to supply the plating solution to the plating solution holding unit 2 again. The heater 16 configured to heat the plating solution and the agitator 17 configured to homogenize the temperature of the plating solution are mounted to the reservoir tank 15.

The plating apparatus may consist of the rotary electrode 1, the plating solution holding unit 2, and the power supply unit 3. In addition, the plating apparatus may include any one or all of the plating solution supply unit 5, the plating bath 14, and the reservoir tank 15 as required in addition to the rotary electrode 1, the plating solution holding unit 2, and the power supply unit 3.

Next, steps of a plating method using the above-mentioned plating apparatus are specifically described. Here, the description is given of an example in which silver plating is performed on a copper alloy material, which is a versatile example as a target of plating treatment. However, the target of the plating treatment is not limited to the copper alloy material. Further, the plating method using the above-mentioned plating apparatus is not limited to a method in which the silver plating is performed. In addition, the plating apparatus is used only in a plating step. Accordingly, the plating apparatus it not used in a degreasing step, an acid cleaning step, and a neutralization step each serving as a pre-treatment step. Further, the plating apparatus is not used also in a water washing step to be performed between the steps of the plating method.

<Degreasing Step>

First, a copper alloy material processed into a preset shape is prepared as the object 4 to be plated. Then, the object to be plated is subjected to degreasing treatment with a degreasing treatment agent. With this, a surface contaminant, such as organic foreign matter, is removed from the surface of the object 4 to be plated, to thereby ensure solution wettability. As the degreasing treatment agent, for example, a sodium hydroxide-based or sodium carbonate-based commercially available alkaline degreasing agent may be used.

<Acid Cleaning Step>

Next, the object 4 to be plated is subjected to acid cleaning treatment with an acid cleaning agent. With this, a surface contaminant, such as inorganic foreign matter, and an oxide film are removed from the surface of the copper alloy material. Through the acid cleaning step, an active metal surface is exposed to ensure the solution wettability, to thereby ensure adhesiveness between a plating film to be formed in the subsequent plating step and the object 4 to be plated serving as a base material. As the acid cleaning agent, for example, an etching solution obtained by diluting nitric acid or sulfuric acid, or a commercially available acid cleaning agent may be used.

<Neutralization Step>

Next, the object 4 to be plated is subjected to neutralization treatment with a neutralization treatment agent. With this, traces of acid remaining on the surface of the copper alloy material are removed, to thereby suppress corrosion of the copper alloy material. As the neutralization treatment agent, sodium cyanide serving as a cyanide-based material, a sodium hydroxide-based washing liquid obtained by dilute blending, or a commercially available neutralization treatment agent may be used.

<Plating Step>

Next, the object 4 to be plated is subjected to silver plating treatment with a silver plating solution. In the plating step, a silver plating film having high film thickness uniformity is formed on the portion 4*a* to be plated of the object 4 to be plated. As a characteristic method of silver electroplating, cathode electrolytic treatment, which is generally performed as the plating treatment, is performed.

As the conditions of the silver electroplating, a plating time, a current density, and a solution temperature may be appropriately set. The plating time refers to a time for which the object 4 to be plated is brought into contact with the plating solution holding unit 2 having held the silver plating solution through impregnation therewith. For example, when the plating time is set to 30 seconds, the current density is set to 20 A/dm$^2$, and the solution temperature is set to 25° C., a silver plating film 4*b* having a thickness of 5 μm is obtained. When the silver plating treatment is performed, the plating solution is preferably used around the above-mentioned temperature. The solution temperature may be appropriately adjusted depending on the state of the object 4 to be plated.

As the silver plating solution to be used in the plating step, any plating solution for silver plating that has hitherto been known may be used. For example, a plating solution prepared by using 1 wt % to 5 wt % of a silver ion in terms of a metal salt, 30 wt % to 40 wt % of potassium iodide, and 1 wt % to 5 wt % of methanesulfonic acid and adjusted to a pH of 7 may be used as the plating solution for silver plating. In addition, a plating solution prepared by using 3 wt % to 15 wt % of a silver ion in terms of a metal salt, 5 wt % to 15 wt % of free cyanide, and 2 wt % to 7 wt % of potassium carbonate may be used as the plating solution for silver plating. In the present invention, the expression "wt %" refers to a value with respect to the entirety of a prepared solution, unless otherwise stated.

When the plating treatment is performed, first, the object 4 to be plated is held by an arm (not shown). At this time, the object 4 to be plated is spaced apart from the plating solution holding unit 2. A mechanism including the arm (not shown) for holding the object 4 to be plated is configured to be able to adjust a contact pressure of the portion 4*a* to be plated to the plating solution holding unit 2. With this, the plating film 4*b* to be formed on the portion 4*a* to be plated can have a sound target film thickness. The contact pressure is preferably from 1.2 kgf to 4.2 kgf. When the contact pressure is less than 1.2 kgf, particularly in the silver plating film, there is a problem in that burning is liable to occur in the plating film, and thus a sound plating film is not obtained. In addition, when the contact pressure is more than 4.2 kgf, there is a problem in that the growth of the plating film 4*b* is inhibited by the wearing between the plating film 4*b* having been deposited and the plating solution holding unit 2, and thus the target plating thickness is not obtained.

After the contact pressure of the portion 4*a* to be plated to the plating solution holding unit 2 is adjusted, the rotary electrode 1 is rotated. The rotation speed of the rotary electrode 1 is preferably such that a relative speed between the object 4 to be plated and the rotary electrode 1 to be brought into contact with each other falls within the range of from 12.5 m/sec to 17.5 m/sec. When the relative speed is less than 12.5 m/sec, particularly in the silver plating, there is a problem in that burning occurs in the plating film, and thus a sound plating film is not obtained. In addition, when the relative speed is more than 17.5 m/sec, the wearing between the plating film 4*b* having been deposited and the plating solution holding unit 2 is increased. This results in a problem in that the growth of the plating film 4*b* is inhibited, and thus the target plating thickness is not obtained.

Next, the supply amount of the plating solution to the plating solution holding unit 2 is adjusted. The supply amount of the plating solution is adjusted by activating the pump 7 and adjusting the solution supply valve 8 and the flow rate adjusting valve 9. When the pump 7 is activated, the plating solution stored in the reservoir tank 15 flows through the solution delivery pipe 11, the pump 7, and the solution supply pipe 6 in this order to reach the ejection port 6*a*. Then, the plating solution is supplied from the ejection port 6*a* to the plating solution holding unit 2 placed on the rotary electrode 1. The plating solution supplied from the ejection port 6*a* is held, through impregnation, by the plating solution holding unit 2 placed on the rotary electrode 1. The temperature of the plating solution may be appropriately set so that the target silver plating film thickness is obtained. For example, the temperature of the plating solution is set to 25° C. When the silver plating treatment is performed, the plating solution is preferably used around the above-mentioned temperature, but the solution temperature may be appropriately adjusted depending on the state of the object 4 to be plated, which is the copper alloy material.

The supply amount of the plating solution is appropriately adjusted depending on the sizes of the rotary electrode 1 and the object 4 to be plated. For example, when the rotary electrode 1 has a size of φ500 mm and the portion 4*a* to be plated has an area of 0.1 $dm^2$, the supply amount of the plating solution is preferably set to from 5 $cm^3$/min to 20 $cm^3$/min. When the supply amount of the plating solution is less than 5 $cm^3$/min, the supply amount of the plating solution becomes insufficient. As a result, there is a problem in that a reduction in film formation rate occurs or plating burning occurs, and thus the target plating film is not obtained. Meanwhile, when the supply amount of the plating solution is more than 20 $cm^3$/min, the supply amount of the plating solution becomes excessive. As a result, there is a problem in that the plating solution adheres also to a portion of the object 4 to be plated other than the portion 4*a* to be plated, that is, a portion of the object 4 to be plated for which the formation of the plating film is not desired, and a partial deposition property is reduced owing to deposition through displacement plating.

After the completion of the above-mentioned adjustment, the power supply unit 3 is switched from an OFF state to an ON state. After the power supply unit 3 is switched to the ON state, the arm that holds the object 4 to be plated is moved to bring the portion 4*a* to be plated into contact with the plating solution holding unit 2. At this time, energization is started at the moment when the portion 4*a* to be plated of the object 4 to be plated is brought into contact with the rotary electrode 1. Under that state, while the rotary electrode is rotated, the silver plating is performed. The plating time is appropriately determined depending on the target plating film thickness. For example, the plating time is set to 30 seconds.

After the silver plating film 4*b* is formed on the portion 4*a* to be plated, post-treatment is performed as required, and the water washing step is performed. Thus, the silver plating film 4*b* can be obtained.

According to the plating apparatus and the plating method of the first embodiment each configured as described above, the rotary electrode 1 is rotated stably at a constant speed while the portion 4*a* to be plated of the object 4 to be plated is brought into contact with the plating solution holding unit impregnated with the plating solution. As a result, the plating film 4*b* having high film thickness uniformity can be formed on the portion 4*a* to be plated.

Second Embodiment

Figure 4:
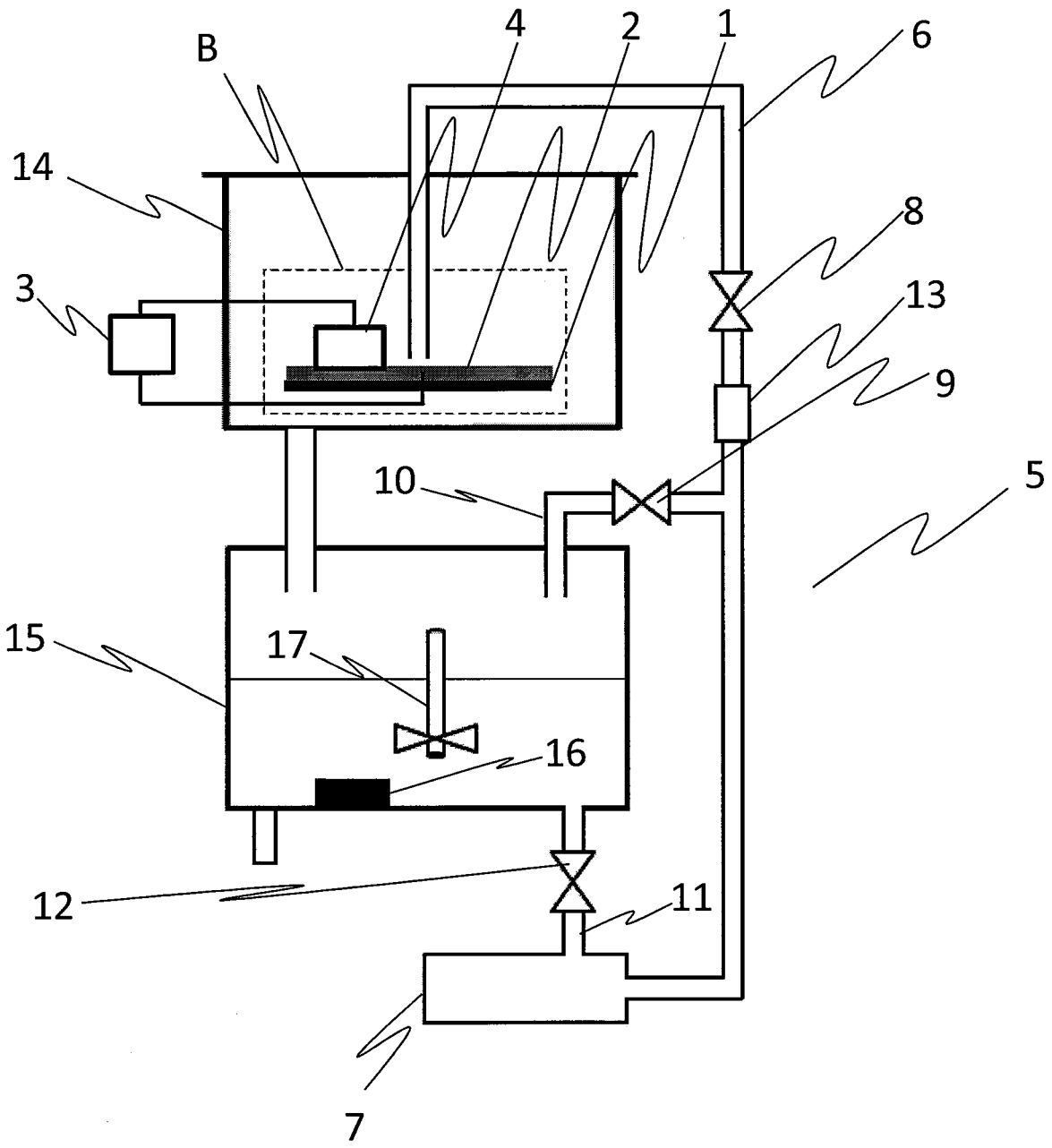
FIG. 4 is a configuration diagram for illustrating a plating apparatus according to a second embodiment of the present invention.
Figure 5:
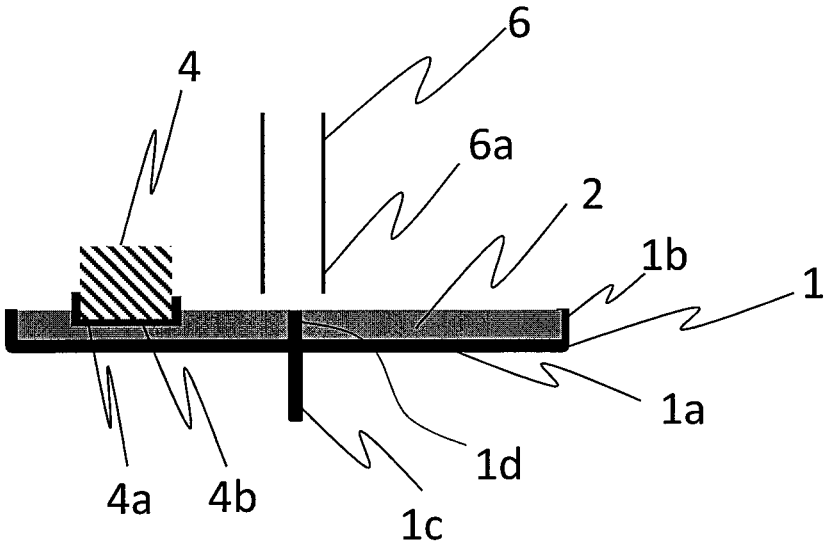
FIG. 5 is a sectional view for illustrating a portion B of FIG. 4.
Figure 6:
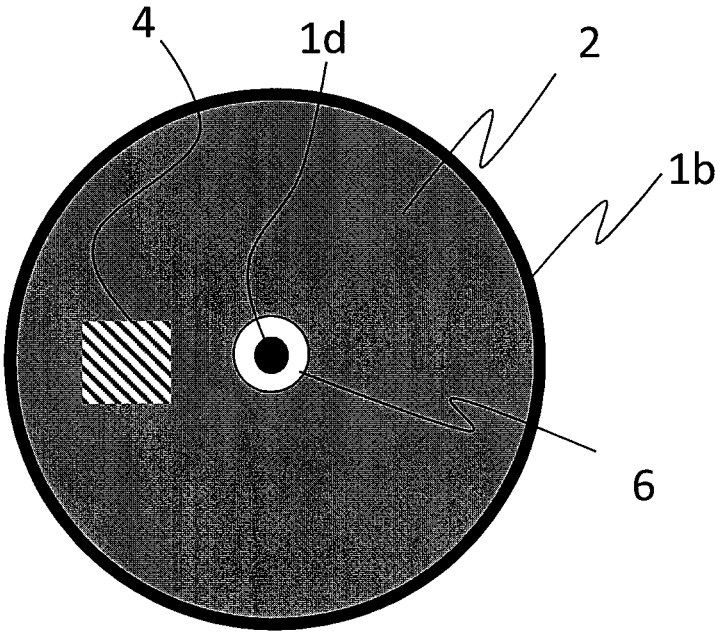
FIG. 6 is a top view for illustrating a rotary electrode of FIG. 5.

FIG. 4 is a configuration diagram for illustrating a plating apparatus according to a second embodiment of the present invention. In addition, FIG. 5 is a sectional view for illustrating a portion B of FIG. 4. Further, FIG. 6 is a top view for illustrating a rotary electrode of FIG. 5. In each of FIG. 4 to FIG. 6, the same components as in the first embodiment are denoted by the same reference symbols, and the descriptions thereof are omitted. The plating apparatus of the second embodiment has the same basic structure as the apparatus described in the first embodiment. The plating apparatus of the second embodiment differs from the plating apparatus of the first embodiment in that the rotary electrode 1 includes: a disc-shaped flat surface portion 1*a* arranged horizontally; a first vertical portion 1*b* arranged at an end portion of the flat surface portion 1*a*; and a second vertical portion 1*d* arranged at a center portion of the flat surface portion 1*a*. The first vertical portion 1*b* and the second vertical portion 1*d* are each arranged vertically to the flat surface portion 1*a*. In addition, the first vertical portion 1*b* extends upward from the end portion of the flat surface portion 1*a*. The second vertical portion 1*d* extends upward from the center portion of the flat surface portion 1*a*. Further, the first vertical portion 1*b* is arranged circularly around an outer periphery of the flat surface portion 1*a*. The second vertical portion 1*d* is arranged in a rod shape at the center portion of the flat surface portion 1*a*. The second vertical portion is arranged coaxially with the shaft 1*c*. In addition, the plating solution holding unit 2 is arranged in a space surrounded by the first vertical portion 1*b*. The plating solution holding unit 2 is held by the flat surface portion 1*a* and the first vertical portion 1*b*.

Next, a plating method using the above-mentioned plating apparatus is described. Here, the description is given of an example in which silver plating is performed on a copper alloy material, which is a versatile example as a target of plating treatment. The plating method using the above-mentioned plating apparatus is not limited to a method in which the silver plating is performed as in the first embodiment. The plating apparatus is used only in a plating step as in the first embodiment. Accordingly, the plating apparatus it not used in a degreasing step, an acid cleaning step, and a neutralization step each serving as a pre-treatment step, and in a water washing step to be performed between the steps. The degreasing step, the acid cleaning step, the neutralization step, and the plating step have been described in the foregoing first embodiment. The degreasing step, the acid cleaning step, and the neutralization step in the second embodiment are the same as in the first embodiment, and hence the descriptions of the degreasing step, the acid cleaning step, and the neutralization step are omitted.

Before plating treatment is performed, as in the first embodiment, a contact pressure between the copper alloy material serving as the object 4 to be plated and the rotary electrode 1, the rotation number of the rotary electrode, and the supply amount of the plating solution are adjusted. In addition, the electrode diameter of the rotary electrode 1 and the supply amount of the plating solution are preferably appropriately adjusted in accordance with the dimensions of the object 4 to be plated.

<Plating Step>

The principle by which displacement deposition on the portion 4*a* to be plated of the object 4 to be plated can be suppressed through use of the above-mentioned plating apparatus and the above-mentioned plating method is described. The first vertical portion 1*b* is arranged at the end portion of the flat surface portion 1*a* of the rotary electrode 1 of the plating apparatus. The second vertical portion 1*d* is arranged at the center portion of the flat surface portion 1*a* of the rotary electrode 1 of the plating apparatus. A silver plating solution has a high displacement deposition property, and hence there is such a possibility that a displacement silver plating film is formed on a portion other than the portion 4*a* to be plated through a displacement reaction between the silver plating solution and the object 4 to be plated. However, in the second embodiment, even when the silver plating solution adheres to the portion other than the portion 4*a* to be plated, the deposition of the displacement plating film can be suppressed by forming an electroplating film 4*b*. That is, even when the silver plating solution adheres to the portion other than the portion 4*a* to be plated, for example, a side surface of the object 4 to be plated, a current can be supplied to the side surface of the object 4 to be plated from the first vertical portion 1*b* and the second vertical portion 1*d* because the first vertical portion 1*b* and the second vertical portion 1*d* are arranged to the rotary electrode 1. As a result, the electroplating film 4*b* can be formed, and thus the deposition of the displacement plating film can be suppressed. Accordingly, the plating film 4*b* having high adhesiveness can be formed on the object 4 to be plated.

According to the plating apparatus and the plating method using the apparatus of the second embodiment each configured as described above, the displacement deposition is suppressed, and the silver plating film 4*b* having high adhesiveness can be formed through electroplating. Thus, the plating film 4*b* formed on the object 4 to be plated can be prevented from being peeled off.

Third Embodiment

Figure 7:
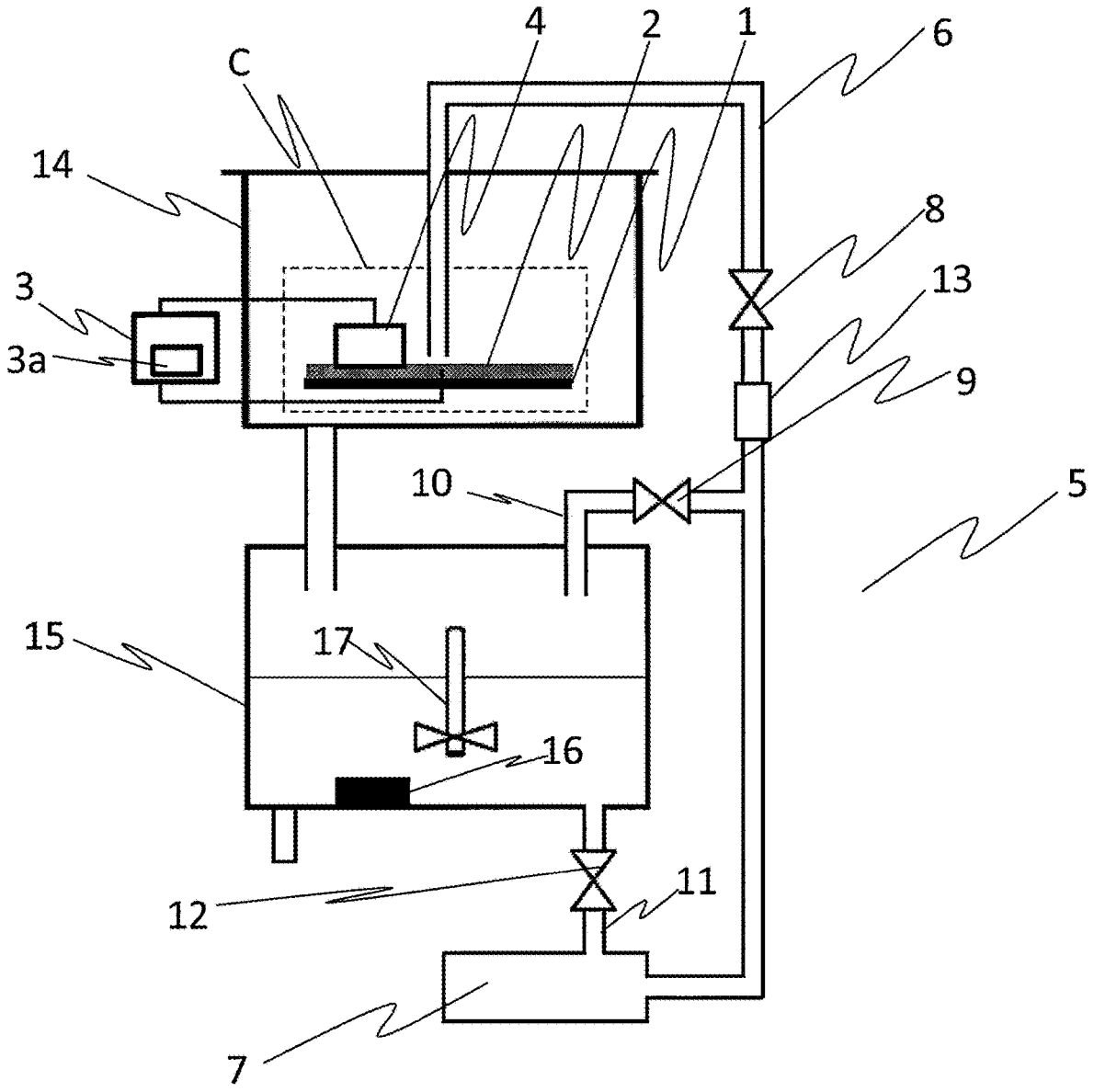
FIG. 7 is a configuration diagram for illustrating a plating apparatus according to a third embodiment of the present invention.

FIG. 7 is a configuration diagram for illustrating a plating apparatus according to a third embodiment of the present invention. A sectional view for illustrating a portion C of FIG. 7 is the same as FIG. 2 in the first embodiment. In addition, a top view for illustrating a rotary electrode 1 and a plating solution holding unit 2 of FIG. 7 is the same as FIG. 3 in the first embodiment. In FIG. 7, the same components as in the first embodiment are denoted by the same reference symbols, and the descriptions thereof are omitted. The plating apparatus of the third embodiment has the same basic structure as the apparatus described in the first embodiment. The plating apparatus of the third embodiment differs from the plating apparatus of the first embodiment in that the plating apparatus includes a power supply unit 3 including a control part 3*a* configured to, while applying a voltage between the portion to be plated and the rotary electrode, perform control of switching an anode and a cathode between the portion to be plated and the rotary electrode at least once or more times during plating treatment. The control part 3*a* is configured to switch the polarity of a DC voltage to be applied between the portion to be plated and the rotary electrode at least once or more times during the plating treatment.

Next, a plating method using the above-mentioned plating apparatus is described. Here, the description is given of an example in which silver plating is performed on a copper alloy material, which is a versatile example as a target of plating treatment. However, the object 4 to be plated is not limited to the copper alloy material. Further, the plating method using the above-mentioned apparatus is not limited to a method in which the silver plating is performed.

The degreasing step, the acid cleaning step, the neutralization step, and the plating step have been described in the foregoing first embodiment. As the degreasing step, the acid cleaning step, and the neutralization step, the same treatments as in the first embodiment are performed in the third embodiment. Accordingly, only the plating step, which differs from that in the first embodiment, is described in the third embodiment.

Before the plating step is performed, a contact pressure between the copper alloy material serving as the object to be plated and the rotary electrode 1, and the rotation number of the rotary electrode are adjusted.

<Plating Step>

In the plating step, while a voltage is applied between the portion 4*a* to be plated and the rotary electrode 1, PR control, which is control of switching an anode and a cathode between the portion 4*a* to be plated and the rotary electrode 1, is performed at least once or more times during plating treatment.

First, a current density is adjusted. A current density at the time when the rotary electrode 1 is used as the anode and the object 4 to be plated, which is the copper alloy material, is used as the cathode is preferably set to from 50% to 100% of a current density at the time when the rotary electrode 1 is used as the cathode and the object 4 to be plated is used as the anode. When the current density at the time when the rotary electrode 1 is used as the anode is less than 50% of the current density at the time when the rotary electrode 1 is used as the cathode, the elution amount of the object to be plated is increased. In this case, the amount of a copper ion to be accumulated in the plating solution as an impurity is increased, and hence the purity and the deposition property of the silver plating film 4*b* are reduced. In addition, when the current density at the time when the rotary electrode 1 is used as the anode is more than 100% of the current density at the time when the rotary electrode 1 is used as the cathode, the removal rate of a plating film in a frayed state is reduced, and hence the partial deposition property of the plating film is reduced.

In addition, with regard to a plating time, a time for which the rotary electrode 1 is used as the cathode and the object 4 to be plated is used as the anode is preferably set to from 20% to 50% of a time for which the rotary electrode 1 is used as the anode and the object 4 to be plated is used as the cathode. When the plating time is less than 20%, the removal rate of the plating film in a frayed state is reduced, and hence the partial deposition property of the plating film is reduced. When the plating time is more than 50%, the elution amount of the object 4 to be plated is increased, and the amount of a copper ion to be accumulated in the plating solution as an impurity is increased. As a result, the purity and the deposition property of the silver plating film 4*b* are reduced.

With regard to the supply amount of the silver plating solution, a supply amount at the time when the rotary electrode 1 is used as the anode and the object 4 to be plated is used as the cathode is preferably set to from 50% to 100% of a supply amount at the time when the rotary electrode 1 is used as the cathode and the object 4 to be plated is used as the anode. When the supply amount at the time when the rotary electrode 1 is used as the anode is less than 50% of the supply amount at the time when the rotary electrode 1 is used as the cathode, the scattering amount of the plating solution supplied at the time when the rotary electrode 1 is used as the cathode is increased, and a displacement plating film is deposited on a portion in which electroplating cannot be controlled. In addition, when the supply amount at the time when the rotary electrode 1 is used as the anode is more than 100% of the supply amount at the time when the rotary electrode 1 is used as the cathode, the dissolution rate of the plating film in a frayed state is reduced. In addition, in this case, the range of the portion 4*a* to be plated covered with the plating solution is reduced, and hence the dissolution range of a displacement silver plating film is reduced. Accordingly, the displacement-deposited silver plating film cannot be completely removed, which results in a problem of a reduction in partial deposition property.

When the current density, the plating time, and the supply amount of the plating solution in the PR control are set as described above, the partial deposition property of the deposited plating film can be improved.

For example, the following conditions of the current density, the plating time, and the supply amount can be adopted.

With regard to the current density, a current density at the time when the rotary electrode 1 was used as the anode and the object 4 to be plated was used as the cathode was set to 15 A/dm$^2$. In addition, a current density at the time when the rotary electrode 1 was used as the cathode and the object 4 to be plated was used as the anode was set to 20 A/dm$^2$.

With regard to the plating time, a plating time at the time when the rotary electrode 1 was used as the anode and the object 4 to be plated was used as the cathode was set to 15 seconds for one plating. In addition, a plating time at the time when the rotary electrode 1 was used as the cathode and the object to be plated was used as the anode was set to 3 seconds for one plating.

With regard to the supply amount of the silver plating solution, the supply amount of the silver plating solution at the time when the rotary electrode 1 was used as the anode and the object 4 to be plated was used as the cathode was set to 10 cm$^3$/min. In addition, the supply amount of the plating solution at the time when the rotary electrode 1 was used as the cathode and the object 4 to be plated was used as the anode was set to 15 cm$^3$/min.

Under the above-mentioned conditions, switching of the polarity between the rotary electrode 1 and the object 4 to be plated was repetitively performed three times. A time for which a voltage was applied was set to 36 seconds in total by performing the following operation twice: a voltage was applied for 18 seconds in total, that is, for 15 seconds when the rotary electrode 1 was used as the anode and for 3 seconds when the rotary electrode 1 was used as the cathode. As a result, the silver plating film 4*b* having a thickness of 5 μm was able to be formed on the portion 4*a* to be plated.

After the silver plating film 4*b* is formed on the portion 4*a* to be plated, post-treatment is performed as required, and a water washing step is performed. Thus, the silver plating film 4*b* can be obtained.

The principle by which the silver plating film having a high partial deposition property can be formed only in a specific region through use of the above-mentioned plating apparatus and the above-mentioned plating method is described. The plating apparatus includes the power supply unit 3 including the control part 3*a* capable of performing the PR control. When the rotary electrode 1 is used as the anode and the object 4 to be plated is used as the cathode, the plating film 4*b* is formed on the portion 4*a* to be plated. At this time, the plating film extends along a bottom surface of the portion 4*a* to be plated to grow horizontally, and a plating film in a frayed state may be formed in some cases. The unrequired plating film can be dissolved and removed when the rotary electrode 1 is used as the cathode and the object 4 to be plated is used as the anode. The plating film in a frayed state has a plating film thickness as small as 0.5 μm or less as compared to the sound plating film 4*b* formed on the portion 4*a* to be plated. In addition, the degree of protrusion of the plating film in a frayed state from an end portion of the portion 4*a* to be plated is about 10% with respect to the area of the portion to be plated. Therefore, in the same manner as above, the plating film in a frayed state can be removed through short-time treatment in which the rotary electrode 1 is used as the cathode and the object 4 to be plated is used as the anode, and thus the partial deposition property of the plating film can be improved.

After the plating step, post-treatment is performed as required, and the water washing step is performed. Thus, the silver plating film 4*b* can be obtained in the specific region.

According to the plating apparatus and the plating method using the apparatus of the third embodiment each configured as described above, the plating film in a frayed state can be dissolved and removed through the PR control. With this, the plating film having high film thickness uniformity and a high partial deposition property can be formed on the portion 4*a* to be plated of the copper alloy material.

The electrode diameter of the rotary electrode 1 and the supply amount of the plating solution are preferably appropriately adjusted in accordance with the dimensions of the object 4 to be plated.

Fourth Embodiment

Figure 8:
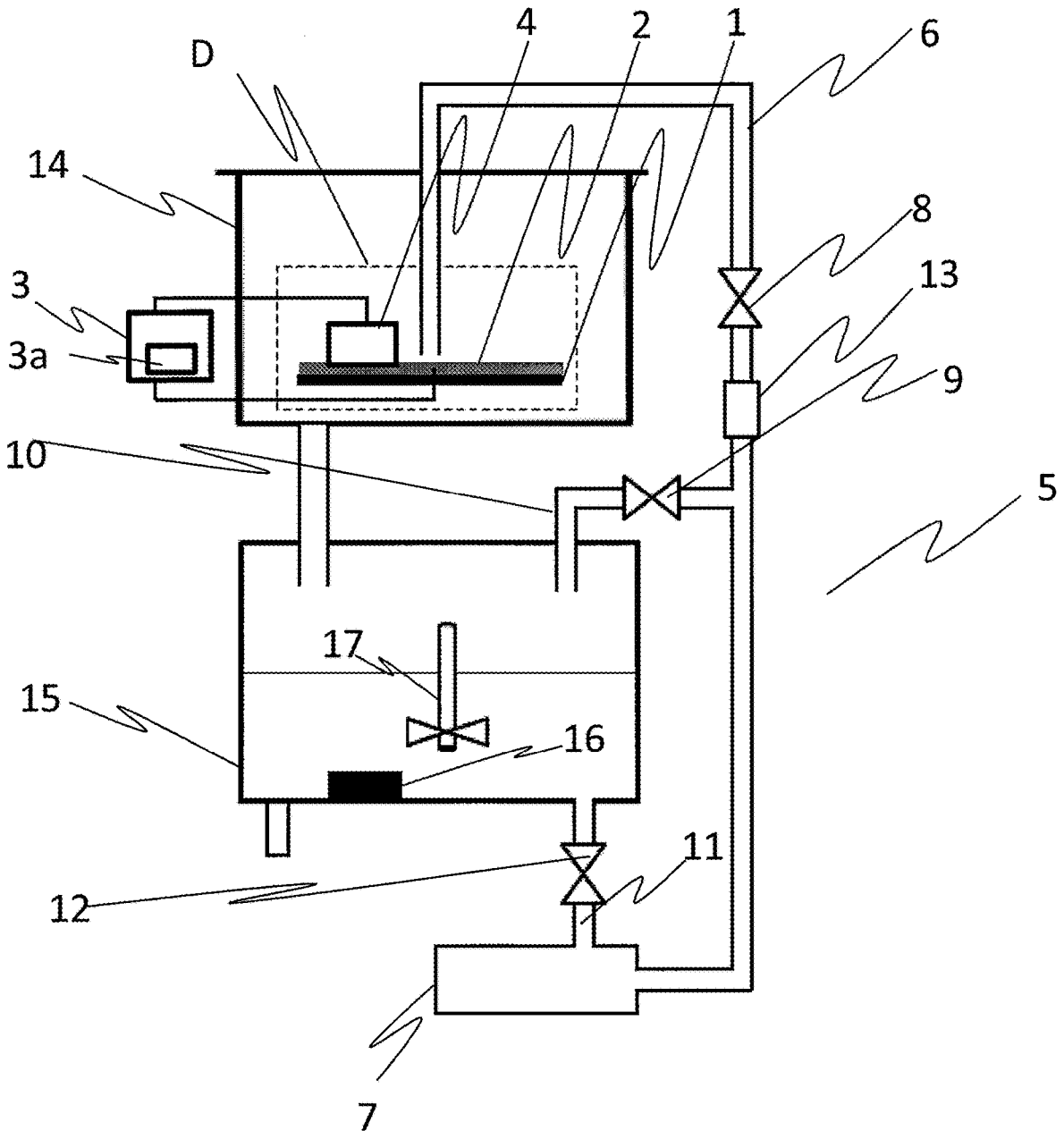
FIG. 8 is a configuration diagram for illustrating a plating apparatus according to a fourth embodiment of the present invention.

FIG. 8 is a configuration diagram for illustrating a plating apparatus according to a fourth embodiment of the present invention. A sectional view for illustrating a portion D of FIG. 8 is the same as FIG. 5 in the second embodiment. In addition, a top view for illustrating a rotary electrode 1 and a plating solution holding unit 2 of FIG. 8 is the same as FIG. 6 in the second embodiment. In FIG. 8, the same components as in the first embodiment are denoted by the same reference symbols, and the descriptions thereof are omitted. The plating apparatus of the fourth embodiment has a configuration in which the rotary electrode 1 having been described in the second embodiment and the power supply unit 3 including the control part 3*a* configured to perform the PR control having been described in the third embodiment are incorporated in the first embodiment.

That is, with regard to the rotary electrode, the configuration is such that the rotary electrode 1 of the foregoing first embodiment is replaced by the rotary electrode 1 of the foregoing second embodiment including: the flat surface portion 1*a*; the first vertical portion 1*b* arranged at the end portion of the flat surface portion 1*a*; and the second vertical portion 1*d* arranged at the center portion of the flat surface portion 1*a*. In addition, with regard to the control of the plating treatment, the configuration is such that the control manner of the foregoing first embodiment is replaced by the control manner of the foregoing third embodiment using the power supply unit 3 including the control part 3*a* capable of performing the PR control.

According to the above-mentioned plating apparatus and plating method, while also a portion other than the portion 4*a* to be plated, for example, a side surface of the object 4 to be plated is counted in, a uniform deposition property on the portion to be plated and the degree of suppression of the formation of a frayed portion can be improved as compared to those in the first embodiment and the second embodiment.

The principle by which the sound silver plating film 4*b* in which the uniform deposition property is high and the formation of the frayed portion is suppressed can be formed through use of the above-mentioned plating apparatus and the above-mentioned plating method is described. The rotary electrode 1 includes: the first vertical portion 1*b* arranged at the end portion of the flat surface portion 1*a*; and the second vertical portion 1*d* arranged at the center portion of the flat surface portion 1*a*. The power supply unit 3 includes the control part 3*a* capable of performing the PR control. In the case in which the thickness of the plating film varies in a deposition region of the plating film, when a voltage is applied by using the rotary electrode as the cathode and using the object to be plated as the anode, dissolution proceeds mainly in a portion of the plating film having a large thickness, at which electroplating is easily concentrated. As a result, through the dissolution, the uniform deposition property is not reduced and can be improved.

In addition, electroplating is easily concentrated at the horizontally-deposited frayed portion by virtue of the first vertical portion 1*b* at the end portion of the flat surface portion 1*a* of the rotary electrode 1 and the second vertical portion 1*d* at the center portion of the flat surface portion 1*a* thereof, and the power supply unit 3 including the control part 3*a* configured to perform the PR control having been described. With this, a current density is increased during the dissolution, and hence the formation of the frayed portion can be suppressed more effectively than in the first embodiment. In addition, the displacement plating film, albeit in a small amount, may be formed on the portion other than the portion 4*a* to be plated, for example, the side surface of the object 4 to be plated in some cases. In such cases, the rotary electrode 1 includes the first vertical portion 1*b* and the second vertical portion 1*d*, which effectively act on the side surface of a surface to be plated, and hence not the displacement plating film but the sound electroplating film 4*b* having high adhesiveness can be formed on the side surface of the object 4 to be plated.

EXAMPLES

The present invention is described by way of Examples below. The present invention is not limited to these Examples.

Examples 1 to 3 are each based on the first embodiment having been described. Specifically, a material for an object to be plated is oxygen-free copper. Here, a material C 1011 was used as the oxygen-free copper. In addition, the object to be plated has the following size: a square bar measuring 100 mm by 100 mm by 100 mm. A flat surface measuring 100 mm by 100 mm on the surface of the square bar serves as a portion to be plated of the object to be plated. By the plating apparatus and plating method having been described in the first embodiment, plating was performed on the copper material.

First, degreasing treatment was performed. In a degreasing treatment step, the degreasing treatment was performed through use of a degreasing agent ELC-400 (manufactured by World Metal Co., Ltd.) in order to remove organic matter. After that, the copper material was immersed in pure water and left to stand for 1 minute, followed by being taken out therefrom.

Next, acid cleaning was performed in accordance with the acid cleaning treatment having been described in the first embodiment. As the acid cleaning, acid cleaning treatment using 30 wt % nitric acid was performed, and the copper material was then immersed in pure water and left to stand for 1 minute, followed by being taken out therefrom.

Next, neutralization treatment was performed in accordance with the neutralization treatment having been described in the first embodiment. As the neutralization treatment, neutralization treatment using a neutralization agent #411Y (manufactured by Dipsol Chemicals Co., Ltd.) was performed in order to remove traces of acid, which had not been able to be removed through a water washing step after the acid cleaning step. After that, the copper material was immersed in pure water and left to stand for 1 minute.

After that, three kinds of silver plating films 4*b* having a thickness of 2 μm, 5 μm, and 10 μm were formed by the plating method having been described in the first embodiment. Each of the silver plating films 4*b* was obtained through treatment using a silver cyanide plating solution 30820 (manufactured by AIKOH Co., Ltd.) under the standard conditions having been described in the first embodiment. As water washing treatment serving as post-treatment, the copper material was immersed in pure water and left to stand for 1 minute.

After the copper material was dried, the external appearance of the copper material was visually observed. After the observation of the external appearance, in order to evaluate the film thickness uniformity of the silver plating film, the film thickness was evaluated with a fluorescent X-ray film thickness meter at five points in total, that is, a center of the silver plating film 4*b* and four points on the left, the right, the top, and the bottom each at 10 mm from an end portion of a surface to be plated. In addition, the presence or absence of plating burning and the presence or absence of a frayed portion in the plating film were confirmed with an optical microscope. Finally, the adhesiveness of the silver plating film formed on a side surface of the object to be plated was evaluated.

Examples 4 to 6 are each based on the second embodiment having been described. In each of Examples 4 to 6, the same copper material as in Examples 1 to 3 was used. As a plating apparatus, a plating apparatus including the rotary electrode 1 having been described in the second embodiment was used. Accordingly, in each of Examples 4 to 6, the rotary electrode 1 including: the flat surface portion 1*a*; the first vertical portion 1*b* arranged at the end portion of the flat surface portion 1*a*; and the second vertical portion 1*d* arranged at the center portion of the flat surface portion 1*a* was used. In addition, an electrode having a size of φ500 mm was used as the rotary electrode 1. As a plating method, the plating method having been described in the first embodiment was performed. The same treatments as in Example 1 were performed from the degreasing treatment to the neutralization treatment. After the neutralization treatment, three kinds of silver plating films 4*b* having thickness of 2 μm, 5 μm, and 10 μm were obtained. After that, the same post-treatment and evaluation methods after the plating as in Examples 1 to 3 were also performed.

Examples 7 to 9 are each based on the third embodiment having been described. In each of Examples 7 to 9, the same copper material as in Examples 1 to 6 was used. As a plating apparatus, a plating apparatus including the power supply unit 3 having been described in the third embodiment was used. Accordingly, in each of Examples 7 to 9, the power supply unit 3 including the control part 3*a* capable of performing the PR control was used. An electrode having a size of φ500 mm was used as the rotary electrode 1. As a plating method, the plating method having been described in the third embodiment was performed. The same treatments as in Example 1 were performed from the degreasing treatment to the neutralization treatment. After the neutralization treatment, three kinds of silver plating films 4*b* having thickness of 2 μm, 5 μm, and 10 μm were obtained. After that, the same post-treatment and evaluation methods after the plating as in Examples 1 to 6 were also performed.

Examples 10 to 12 are each based on the fourth embodiment having been described. In each of Examples 10 to 12, the same copper material as in Examples 1 to 9 was used. As a plating apparatus, a plating apparatus including the rotary electrode having been described in Example 2 and the same power supply unit 3 used in Example 3 was used. Accordingly, in each of Examples 10 to 12, the rotary electrode 1 including: the flat surface portion 1*a*; the first vertical portion 1*b* arranged at the end portion of the flat surface portion 1*a*; and the second vertical portion 1*d* arranged at the center portion of the flat surface portion 1*a* was used. An electrode having a size of φ500 mm was used as the rotary electrode 1. In addition, in each of Examples 10 to 12, the power supply unit 3 including the control part 3*a* capable of performing the PR control was used. As a plating method, the plating method having been described in the third embodiment was performed. After the neutralization treatment, three kinds of silver plating films 4*b* having thickness of 2 μm, 5 μm, and 10 μm were obtained. After that, the same post-treatment and evaluation methods after the plating as in Examples 1 to 9 were also performed.

The performance conditions of Examples 1 to 12 are shown in FIG. 9. As the current density, a current density at the time when the rotary electrode 1 was used as the anode was shown.

Next, Examples obtained under the plating conditions of Examples 1 to 12 according to the present invention were each subjected to film thickness measurement, observation, and evaluation. The results are shown in FIG. 10.

First, the film thickness was measured with a fluorescent X-ray film thickness meter. The thickness of the silver plating film was measured by regarding the following five points in total as measurement sites for the thickness of the silver plating film: a center of a surface to be plated and four points on the left, the right, the top, and the bottom each at 10 mm from an end portion of the surface to be plated. σ and an average for the data on the film thicknesses at the five points in total were determined, and a value for σ/average was calculated and used as a representative value of each Example.

Next, the results of Examples are compared with the results of Comparative Examples.

In each of Examples 1 to 3 according to the first embodiment, which included the rotary electrode, variation in film thickness was significantly reduced as compared to each of Comparative Examples 13 to 15 according to the related art, which included a brush-shaped electrode. Also in each of Examples 4 to 12 according to the second embodiment to the fourth embodiment, variation in film thickness was reduced as compared to Comparative Examples 13 to 15. In addition, in each of Examples 4 to 12, variation in film thickness was further reduced as compared to Examples 1 to 3. In particular, each of Examples 9 to 12 according to the fourth embodiment, which included: the rotary electrode 1 including the flat surface portion 1*a*, the first vertical portion 1*b*, and the second vertical portion 1*d*; and the power supply unit 3 including the control part 3*a* capable of performing the PR control, variation in film thickness was most reduced.

Further, the presence or absence of plating burning and the presence or absence of a frayed portion in the plating film were observed with an optical microscope at 100-fold magnification. As a result, plating burning occurred in Comparative Examples 13 to 15 according to the related art, which included a brush-shaped electrode, whereas plating burning did not occur in Examples 1 to 12 according to the first embodiment, which included the rotary electrode. With regard to a frayed portion in the plating film, a frayed portion of the plating film did not occur in all Examples in which the PR control was performed, that is, in Examples 7 to 12.

Finally, the adhesiveness of the silver plating film formed on the side surface of the object to be plated was evaluated. The adhesiveness was evaluated according to JIS standards. CELLOTAPE (trademark) manufactured by Nichiban Co., Ltd. was used, and a tape peeling test in which CELLOTAPE was brought into close contact with the plating film on the entire side surface of the copper material and was then peeled therefrom was performed. As a result, in all Examples in which the rotary electrode 1 not including the first vertical portion 1*b* and the second vertical portion 1*d* was used, that is, in Examples 1 to 3 and 7 to 9, peeling of the plating film occurred. Meanwhile, in all Examples in which the rotary electrode 1 including the first vertical portion 1*b* and the second vertical portion 1*d* was used, that is, in Examples 4 to 6 and 10 to 12, peeling of the plating film did not occur.

REFERENCE SIGNS LIST

1 rotary electrode, 1*a* flat surface portion, 1*b* first vertical portion, 1*c* shaft, 1*d* second vertical portion, 2 plating solution holding unit, 3 power supply unit, 3*a* control part, 4 plated object, 4*a* plated portion, 4*b* plating film, 5 plating solution supply unit, 6 solution supply pipe, 6*a* ejection port, 7 pump, 8 solution supply valve, 9 flow rate adjusting valve, 10 flow rate adjusting pipe, 11 solution delivery pipe, 12 solution delivery valve, 13 flow meter, 14 plating bath, 15 reservoir tank, 16 heater, 17 agitator

The invention claimed is:

1. A plating method, comprising:

adjusting a location of a plating solution ejection port and adjusting an ejection flow rate of a plating solution ejected from the plating solution ejection port;

supplying the plating solution to a plating solution holding unit;

placing an object to be plated on a rotary electrode through intermediation of the plating solution holding unit holding the plating solution;

bringing a portion to be plated of the object to be plated into contact with the plating solution holding unit;

rotating the rotary electrode; and applying a voltage between the portion to be plated and the rotary electrode wherein while applying a voltage between the portion to be plated and the rotary electrode, switching a polarity between the portion to be plated and the rotary electrode at least one time during plating treatment and changing an amount of the plating solution supplied when the polarity is switched.

2. The plating method according to claim 1, wherein the rotary electrode has a size larger than a plating area of the object to be plated.

3. The plating method according to claim 1, wherein the object to be plated has a circular track with respect to the rotary electrode.

4. The plating method according to claim 1, wherein the plating solution ejection port is arranged above a center portion of the rotary electrode or is arranged above a circular track of the object to be plated on the rotary electrode.

5. The plating method according to claim 1, wherein a time for which the rotary electrode is used as a cathode and the object to be plated is used as an anode is set to from 20% to 50% of a time for which the rotary electrode is used as the anode and the object to be plated is used as the cathode.

6. A plating method, comprising:

adjusting a location of a plating solution ejection port and adjusting an ejection flow rate of a plating solution ejected from the plating solution ejection port;

supplying the plating solution to a plating solution holding unit;

placing an object to be plated on a rotary electrode through intermediation of the plating solution holding unit holding the plating solution;

bringing a portion to be plated of the object to be plated into contact with the plating solution holding unit;

rotating the rotary electrode, wherein the rotary electrode includes a flat surface portion, a first vertical portion extending upward from a circumferential edge of the flat surface portion and a second vertical portion extending upward from the flat surface portion; and applying a voltage between the portion to be plated and the rotary electrode wherein while applying a voltage between the portion to be plated and the rotary electrode, switching a polarity between the portion to be plated and the rotary electrode at least one time during plating treatment and changing an amount of the plating solution supplied when the polarity is switched, wherein the plating solution ejection port is arranged above a center portion of the rotary electrode, wherein the rotary electrode is configured to be rotatable about an axis line of a shaft, and wherein the plating solution ejection port is arranged on the axis line and the second vertical portion is coaxial with the shaft.

7. The plating method according to claim 6, wherein the rotary electrode has a size larger than a plating area of the object to be plated.

8. The plating method according to claim 6, wherein the object to be plated has a circular track with respect to the rotary electrode.

9. The plating method according to claim 6, wherein a time for which the rotary electrode is used as a cathode and the object to be plated is used as an anode is set to from 20% to 50% of a time for which the rotary electrode is used as the anode and the object to be plated is used as the cathode.

* * * * *